US011992138B1

(12) United States Patent
Brandon et al.

(10) Patent No.: US 11,992,138 B1
(45) Date of Patent: May 28, 2024

(54) TELESCOPING RAIL AND CLAMPING SYSTEM FOR FOOD, BEVERAGE, AND PAYMENT SERVICE WINDOWS

(71) Applicant: Applied Experience LLC, Columbus, OH (US)

(72) Inventors: Christopher L. Brandon, Dublin, OH (US); Bradley S. Cline, London, OH (US); Nancy S. Hodosko, London, OH (US)

(73) Assignee: Applied Experience LLC, Columbus, OH (US)

( * ) Notice: Subject to any disclaimer, the term of this patent is extended or adjusted under 35 U.S.C. 154(b) by 384 days.

(21) Appl. No.: 17/372,385

(22) Filed: Jul. 9, 2021

Related U.S. Application Data

(60) Provisional application No. 63/049,841, filed on Jul. 9, 2020.

(51) Int. Cl.
*A47G 23/00* (2006.01)
*A47F 10/06* (2006.01)
*A47G 23/06* (2006.01)

(52) U.S. Cl.
CPC ..... *A47G 23/0633* (2013.01); *A47F 10/06* (2013.01); *A47G 2023/0666* (2013.01)

(58) Field of Classification Search
None
See application file for complete search history.

(56) References Cited

U.S. PATENT DOCUMENTS

| | | | | | |
|---|---|---|---|---|---|
| 2,193,647 | A * | 3/1940 | Rush | A47B 23/02 | 108/49 |
| 3,118,399 | A * | 1/1964 | Sarkus | A47B 23/02 | 108/49 |
| 3,362,543 | A * | 1/1968 | Boudouris | A47F 10/06 | 211/126.1 |
| 3,465,894 | A * | 9/1969 | Setecka | A47G 23/08 | 211/151 |
| 3,535,720 | A * | 10/1970 | Woods | A47B 23/02 | 5/507.1 |
| 4,157,071 | A * | 6/1979 | King | A47G 29/14 | 109/19 |
| 5,037,162 | A * | 8/1991 | Ransom | A47B 23/04 | 312/236 |
| 5,282,711 | A * | 2/1994 | Frische | A47G 23/0225 | 414/9 |
| 6,742,204 | B1 * | 6/2004 | Barker | A47C 19/22 | 5/507.1 |
| 2010/0140057 | A1 * | 6/2010 | Ishino | A47F 10/06 | 198/867.14 |

* cited by examiner

*Primary Examiner* — Steven M Marsh
(74) *Attorney, Agent, or Firm* — The Law Office of Patrick F. O'Reilly, III, LLC

(57) ABSTRACT

A telescoping rail and clamping system for a food, beverage, or payment service window is disclosed herein. The telescoping rail and clamping system includes a tray with one or more features for holding one or more food, beverage, and/or payment items; at least one telescoping rail member coupled to the tray, the at least one telescoping rail member configured to enable the tray to be displaced a variable distance into and out of an opening of a food, beverage, or payment service window; and a base coupled to the at least one telescoping rail member, the base including a clamping device configured to attach the base to one or more building elements proximate to the food, beverage, or payment service window.

20 Claims, 4 Drawing Sheets

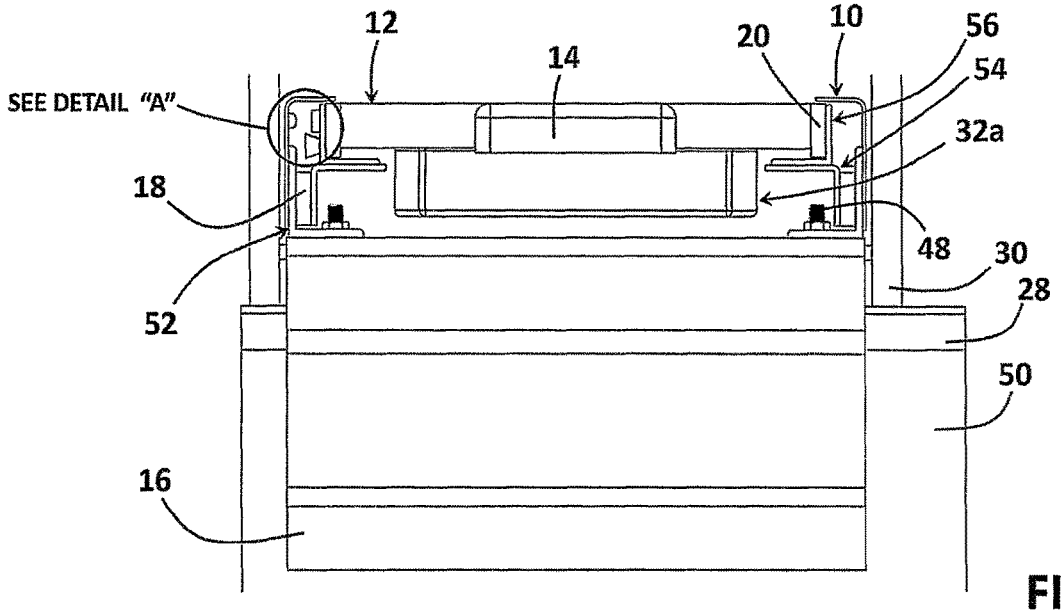
FIG. 3A
FIG. 3B
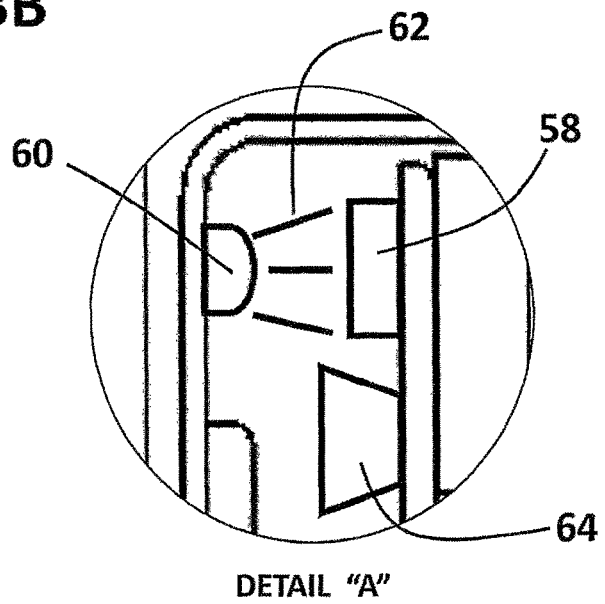

TELESCOPING RAIL AND CLAMPING SYSTEM FOR FOOD, BEVERAGE, AND PAYMENT SERVICE WINDOWS

CROSS-REFERENCE TO RELATED APPLICATIONS

This patent application claims priority to, and incorporates by reference in its entirety, U.S. Provisional Patent Application No. 63/049,841, entitled "Telescoping Rail and Clamping System for Food, Beverage, and Payment Service Windows", filed on Jul. 9, 2020.

BACKGROUND

The exchange of food and beverage items through food and beverage service windows (e.g., drive-through or drive-up windows) poses health, security, and operational concerns as it relates to customer-operator interaction. The exchange can result in direct customer-operator physical contact, expose the operator to theft, and/or increase overall service time due to large or multiple food and beverage product exchanges. In a similar way the exchange of payment at a drive-through window poses health, security, and business concerns.

Present industry practice involves the use of loose trays, cups, gloves, or modified payment machines that aid in reducing customer-operator interaction. The present invention reduces customer-operator interaction by employing a telescoping tray and frame to deliver food and beverage items to the customer. The tray is removeable and configurable to accommodate multiple food and beverage items and attach to a wide range of service window configurations without altering the underlying facility (e.g., drilling holes).

SUMMARY OF THE INVENTION

The present invention relates to a device that reduces or eliminates customer-operator physical contact, improves overall security, and improves service time.

In one aspect the present invention uses a two-tiered telescoping rail system to extend a detachable tray configuration longitudinally but perpendicular to the opening of a food and beverage service window. The tray configuration is thus extended beyond the opening of the window a variable distance up to a maximum extended longitudinal length. The bottom tier supports the top tier which in-turn supports a frame and detachable tray configuration.

In some embodiments the tray configuration is replaceable and includes features for capturing and securing food, beverage, and payment items. The tray configuration is supported by a frame along three edges of the tray. The frame includes a handle attachment positioned opposite the window opening. The tray configuration and frame include a bumper along the edge of the tray and frame positioned toward the window opening. In other embodiments the bumper is affixed at the outer edges of the frame positioned toward the window opening.

In some embodiments the two-tiered telescoping rail system is comprised of rails, angled structural members, and covers on either side of the tray configuration. The covers extend from the base to above the rail system enclosing the rails and angled structural members while leaving the tray configuration accessible.

In another aspect the rail system, tray configuration, and covers are supported by a base that extends from window opening to a lower portion of wall or supporting structure.

The base width extends along the entire opening of the window. The base includes two footpads positioned at the edge of the base closest to the window opening and one footpad that extends the width of the base positioned behind the two footpads and near the center of the base. All footpads are adjustable axially along the length of the threaded foot-pad studs. The foot pads interface with an existing counter or table structure to support the overall device.

In some embodiments a clamping system is attached to the base that interfaces with an existing counter, table structure, or partial wall. The clamping system is composed of a slotted angle component that attaches to the base and provides longitudinal adjustment perpendicular to the window opening and wall or supporting structure. The slotted angle component is adjusted to impinge on the counter or table structure to provide lateral stability. A descending angle component is further attached to the slotted angle component and is positioned below the leading edge of the counter or table structure. A threaded lead screw extends from the base to the descending angle component and captures the descending angle component with a nut affixed to the lead screw but below the descending angle component. Threading the nut onto the lead screw moves the descending angle component to a position that impinges on the underside of the counter or table structure providing upward stability.

In another embodiment an angled block is attached to the lead screw that then interfaces with an angled block attached to the slotted angled component. The nut affixed to the lead screw captures the angled block attached to the lead screw in such a manner that when threaded the angled block impinges on the angled block attached to the slotted angled component causing it to impinge longitudinally on a flat wall or counter. The impinging angled block thus asserts a clamping force on the flat wall or counter in the absence of a undercut ledge or lip feature.

In some embodiments a magnet and sensor are positioned as opposing elements within a cover on one side. When the sensor fails to detect a magnetic field, an audible tone is emitted by a speaker also positioned with a cover on one side. In still another embodiment the rail system is actuated by a set of slides that feature a spring pre-load providing active return of the tray and rail system to a collapsed position after extending. The operator must apply a constant force to maintain the frame and tray in the extended position.

In another embodiment a telescoping armature is mounted to the base and extends a tray configuration outside the service window frame. The telescoping armature articulates such that a tray configuration can move left, right, up, down, in, and out.

BRIEF DESCRIPTION OF THE DRAWINGS

FIG. 18 is a back view of the device shown in FIG. 1A with a portion of the base cut away to show an slotted angle component, lead screw, and descending angled component attachment;

FIG. 3A is a back view of the device shown in FIG. 1A with a detail view call-out;

FIG. 3B is a detail view of the magnet sensor arrangement; and

DESCRIPTION OF THE INVENTION

Figure 1A:
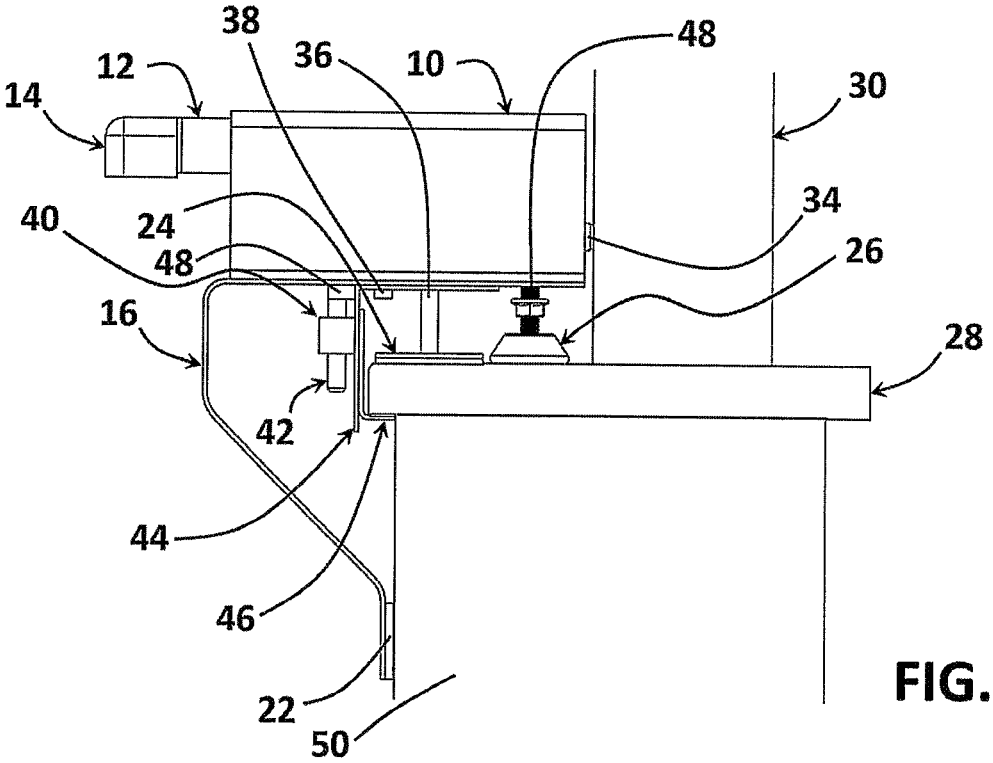
FIG. 1A is a side view of the telescoping clamping device in accordance with an embodiment of the present invention.
Figure 1B:
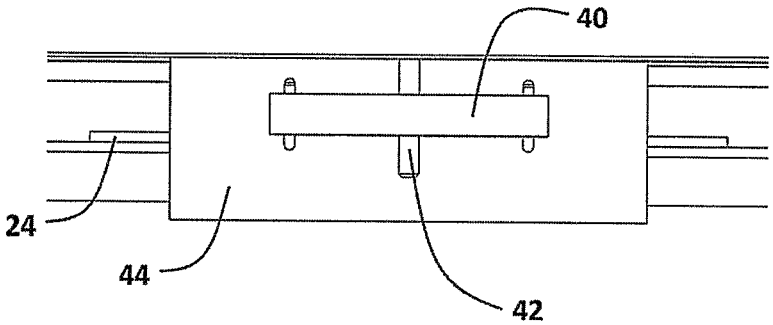
Figure 2A:
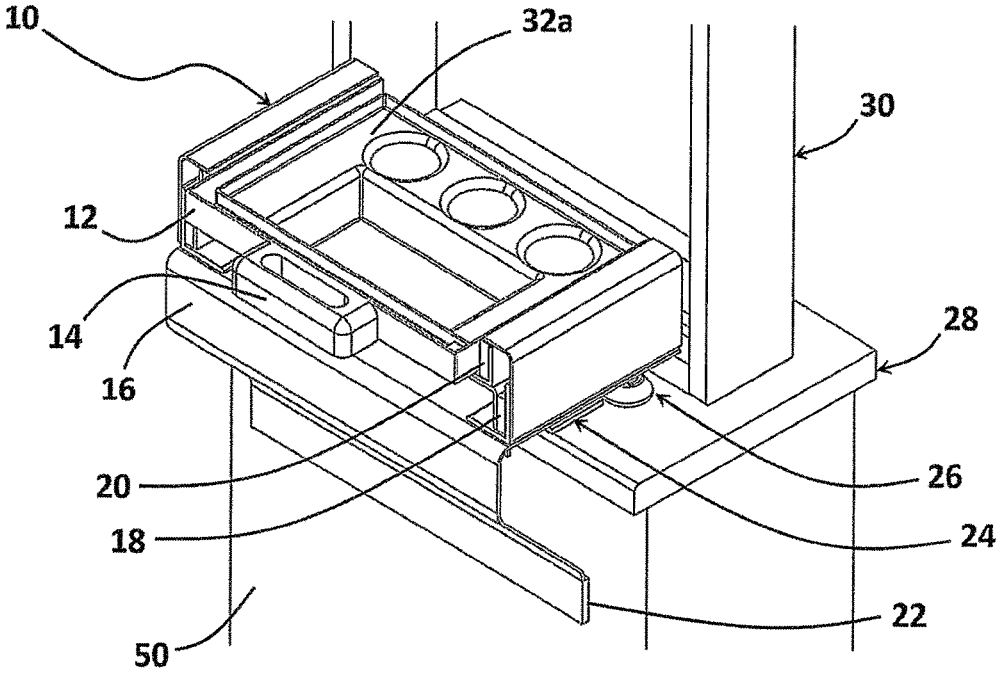
FIG. 2A is an orthographic view of the device shown in FIG. 1A.
Figure 2B:
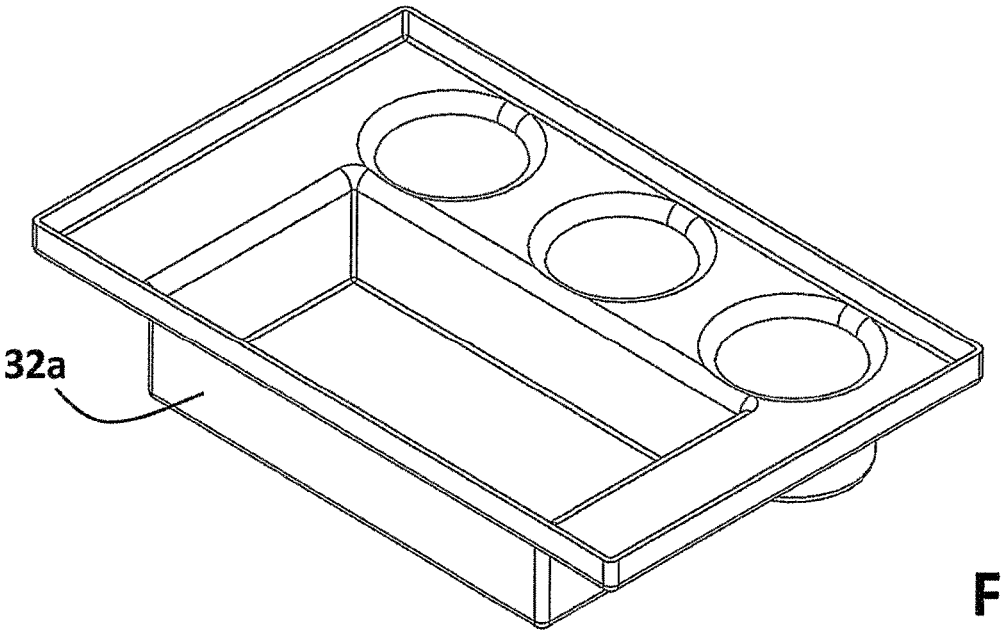
FIG. 2B is a detail view of a tray configuration.

FIG. 1A and FIG. 2A illustrate a representative embodiment of the present invention as attached to a counter 28 adjacent to a window frame 30. The device is affixed to the counter 28 by an adjustable clamp composed of an upper angled member 44 and lower angled member 46. The upper angled member 44 is composed of slots that allow for horizontal adjustment of the clamp as shown in FIG. 1A. In a similar way angled member 44 is slotted in the vertical direction to allow for vertical adjustment of the clamp as shown in FIG. 1A. Adjustment in the vertical direction is actuated by a lead screw and nut 42 that passes through an adjustment block 40 attached to the angle member 46. The lead screw and nut 42 is fixed to the angled member 44 by a termination block 48. Adjustment in the horizontal direction is actuated by pressing the angled member 44 in the direction of clamping. Nut block 38 is tightened to secure the angled member 44 to the base 16. A back-foot pad 24 is affixed to the base 16 by a threaded rod 36 opposite the angled member 46. The counter 28 is captured between the angled member 46 and the back-foot pad 24. Adjustment and fixation of the angled member 46, in combination with the back-foot pad 24, creates a compressive force on the counter 28 securing the device in place. Two front-foot pads 26 attached to the base 16 by threaded rod 48 stabilize the leading edge of the device. The base 16 further extends to impinge on a wall or building structure 50 across a compressive pad 22.

Referring to FIGS. 2A and 3A, a telescoping rail system composed of a lower set of mechanical slides 18 and upper set of mechanical slides 20 position the tray 32*a* and frame 12 longitudinally inside and outside the window frame 30. The lower set of mechanical slides 18 is attached to a set of angled members 52 that form an attachment to the base 16. On the inner track of the lower mechanical slides 18 a set of lower angled members 54 are attached. The set of lower angled members 54 form a base for the upper angled members 56 and attached upper set of mechanical slides 20. The upper set of mechanical slides 20 further extend the frame 12 and tray 32*a* toward a recipient (e.g., car at drive-through or person at walk-up windows) to allow direct access to the contents of the tray 32*a*. The operator further maintains control of the slide action of the upper set of mechanical slides 20 and lower set of mechanical slides 18 by grasping the handle 14 affixed to the frame 12. The lower set of mechanical slides 18 actuate the set of lower angled members 54 and set of upper angled members 56, upper set of mechanical slides 20, frame 12 and tray 32*a* inside and outside the window frame 30. The entire telescoping rail system is enclosed on either side by a set of protective covers 10 when fully collapsed. A set of bumpers 34 is attached to the set of upper angled members 56 on the edge closet to the window frame. In some embodiments the tray 32*a* may be composed of different recess features to accommodate specific applications (e.g., cups, bags, straws, etc.). In another embodiment, the telescoping rail system is removable from the base 16 to allow for cleaning or substitution of an alternative base 16 that uses an alternative clamping method.

Referring to FIG. 3B, a magnet 60 produces a magnetic field 62 that is detected by a sensor 58. In the absence of a magnetic field 62 a speaker 64 emits an audible tone alerting the operator that the frame 12 and tray 32*a* are in the extended state (i.e., extended beyond the window frame 30) and may present a collision hazard for oncoming drive-through or walk-up recipients. When the magnetic field 62 is again presented to the sensor 58 the speaker 64 stops emitting the audible tone alerting the operator the frame 12 and tray 32*a* are in the collapsed state (i.e., collapsed within the window frame 30) and no longer presents a collision hazard for oncoming drive-through or walk-up recipients.

Figure 4:
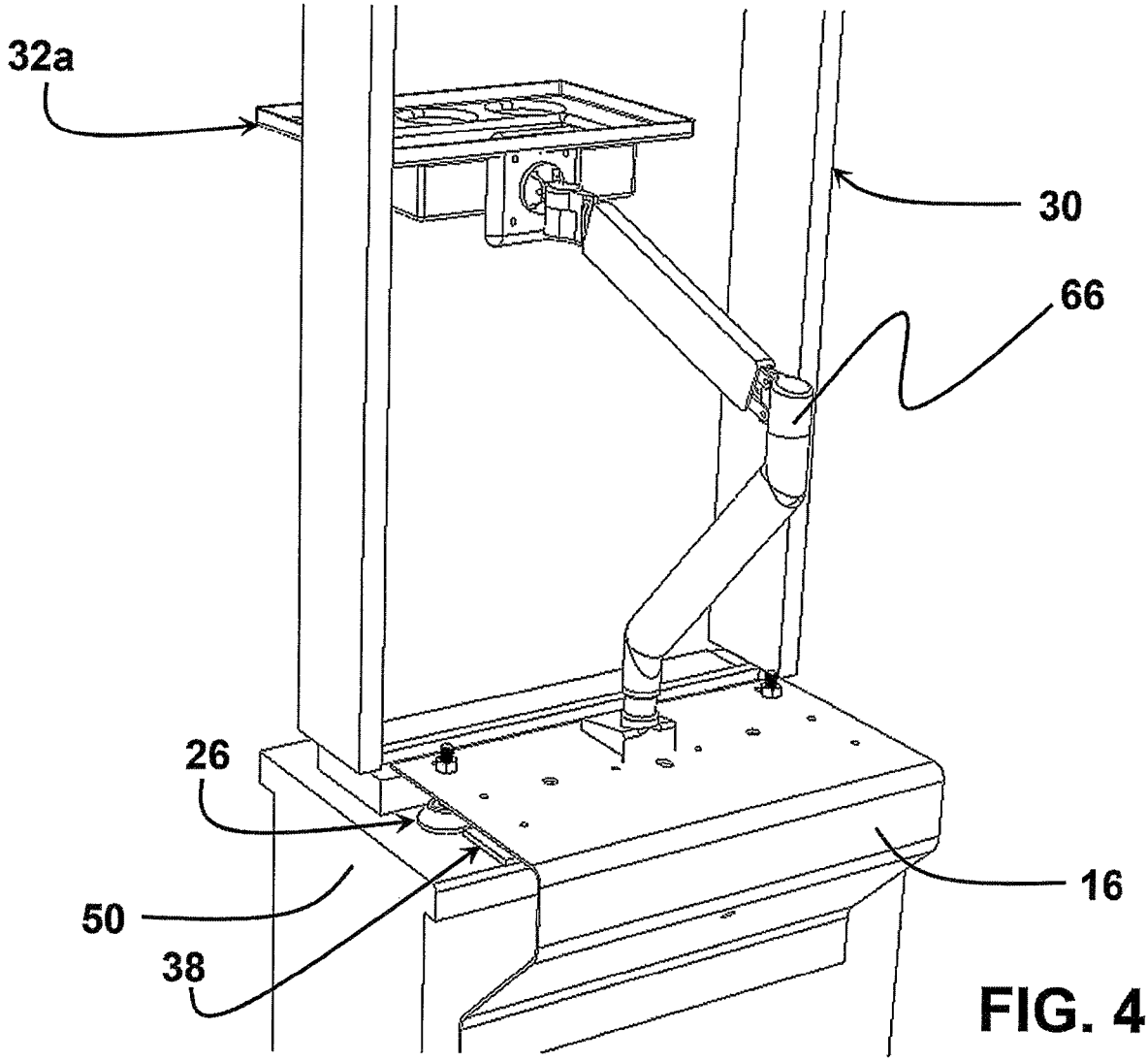
FIG. 4 is an orthographic view of a device embodiment with a telescoping armature.

Referring to FIG. 4, a telescoping armature 66 is mounted to the base 16 and extends from the window frame 30. A tray 32*a* is mounted to the end of the telescoping armature 66 and extends from the window frame 30.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A telescoping rail and clamping system for a food, beverage, or payment service window, said system comprising:

a tray that includes one or more features for holding one or more food, beverage, or payment items;

at least one telescoping rail member coupled to the tray, the at least one telescoping rail member configured to enable the tray to be displaced a variable distance into and out of an opening of a food, beverage, or payment service window; and a base coupled to the at least one telescoping rail member, the base including a clamping device configured to attach the base to one or more building elements proximate to the food, beverage, or payment service window;

wherein the at least one telescoping rail member comprises a first set of lower telescoping rail members and a second set of upper telescoping rail members, the first set of lower telescoping rail members being coupled to the base by a first plurality of angle components, and the second set of upper telescoping rail members being coupled to a frame of the tray.

2. The telescoping rail and clamping system according to claim 1, wherein the first set of lower telescoping rail members are coupled to the second set of upper telescoping rail members by a second plurality of angle components.

3. The telescoping rail and clamping system according to claim 2, further comprising one or more cover members configured to cover at least a portion of the first set of lower telescoping rail members, the second set of upper telescoping rail members, the first plurality of angle components, and the second plurality of angle components.

4. The telescoping rail and clamping system according to claim 1, wherein the base further comprises at least one support foot member configured to support the telescoping rail and clamping system from a ledge, counter, or table structure.

5. The telescoping rail and clamping system according to claim 4, wherein the at least one support foot member is axially adjustable so as to allow a height of the telescoping rail and clamping system to be adjusted.

6. The telescoping rail and clamping system according to claim 1, wherein the clamping device comprises a lower angle member and an upper angle member, the lower angle member being configured to impinge on the underside of a counter or table structure, and the upper angle member being adjustably coupled to the lower angle member so as to allow a height of the telescoping rail and clamping system relative to the counter or table structure to be adjusted.

7. The telescoping rail and clamping system according to claim 6, wherein the upper angle member is adjustably coupled to the lower angle member by one or more threaded fastener members.

8. The telescoping rail and clamping system according to claim 1, wherein the tray is supported by the frame extending along one or more edges of the tray.

9. The telescoping rail and clamping system according to claim 8, wherein the tray is removable from the frame.

10. The telescoping rail and clamping system according to claim 8, wherein the frame further comprises a handle member disposed opposite to the opening of the food, beverage, or payment service window.

11. The telescoping rail and clamping system according to claim 8, wherein the tray further comprises a bumper member disposed along an edge of the tray and positioned towards the opening of the food, beverage, or payment service window.

12. The telescoping rail and clamping system according to claim 8, further comprising a sensor assembly configured to detect an extended state and a collapsed state of the frame and the tray;

when the frame and the tray are in the extended state, the sensor assembly emits at least one of an audible indicator and a visual indicator so as to alert an operator that the frame and the tray could present a collision hazard for oncoming drive-through or walk-up recipients; and when the frame and the tray are in the collapsed state, the sensor assembly does not emit the at least one of the audible indicator and the visual indicator.

13. The telescoping rail and clamping system according to claim 12, wherein the sensor assembly comprises a magnet for producing a magnetic field, a sensor for detecting the magnetic field, and a speaker for emitting the audible indicator;

when the frame and the tray are in the extended state, the sensor does not detect the magnetic field produced by the magnet, and the speaker emits the audible indicator; and when the frame and the tray are in the collapsed state, the sensor detects the magnetic field produced by the magnet, and the speaker does not emit the audible indicator.

14. A telescoping armature and clamping system for a food, beverage, or payment service window, said system comprising:

a tray that includes one or more features for holding one or more food, beverage, or payment items;

a telescoping armature coupled to the tray, the telescoping armature configured to enable the tray to be displaced a variable distance into and out of an opening of a food, beverage, or payment service window; and a base coupled to the telescoping armature, the base including a clamping device configured to attach the base to one or more building elements proximate to the food, beverage, or payment service window;

wherein the clamping device comprises a lower angle member and an upper angle member, the lower angle member being configured to impinge on the underside of a counter or table structure, and the upper angle member being adjustably coupled to the lower angle member so as to allow a height of the telescoping armature and clamping system relative to the counter or table structure to be adjusted.

15. The telescoping armature and clamping system according to claim 14, wherein the base further comprises at least one support foot member configured to support the telescoping armature and clamping system from a ledge, the counter, or the table structure.

16. The telescoping armature and clamping system according to claim 15, wherein the at least one support foot member is axially adjustable so as to allow a height of the telescoping armature and clamping system to be adjusted.

17. The telescoping armature and clamping system according to claim 14, wherein the upper angle member is adjustably coupled to the lower angle member by one or more threaded fastener members.

18. A telescoping rail and clamping system for a food, beverage, or payment service window, said system comprising:

a tray that includes one or more features for holding one or more food, beverage, or payment items;

at least one telescoping rail member coupled to the tray, the at least one telescoping rail member configured to enable the tray to be displaced a variable distance into and out of an opening of a food, beverage, or payment service window; and a base coupled to the at least one telescoping rail member, the base including a clamping device configured to attach the base to one or more building elements proximate to the food, beverage, or payment service window;

wherein the clamping device comprises a lower angle member and an upper angle member, the lower angle member being configured to impinge on the underside of a counter or table structure, and the upper angle member being adjustably coupled to the lower angle member so as to allow a height of the telescoping rail and clamping system relative to the counter or table structure to be adjusted.

19. The telescoping rail and clamping system according to claim 18, wherein the upper angle member is adjustably coupled to the lower angle member by one or more threaded fastener members.

20. The telescoping rail and clamping system according to claim 18, wherein the base further comprises at least one support foot member configured to support the telescoping rail and clamping system from a ledge, the counter, or the table structure.

* * * * *